US010161731B2

(12) United States Patent
Lish

(10) Patent No.: US 10,161,731 B2
(45) Date of Patent: Dec. 25, 2018

(54) SOUND EMITTING TRACKABLE ARROW

(71) Applicant: Lucas J. Lish, Pocatello, ID (US)

(72) Inventor: Lucas J. Lish, Pocatello, ID (US)

( * ) Notice: Subject to any disclaimer, the term of this patent is extended or adjusted under 35 U.S.C. 154(b) by 19 days.

(21) Appl. No.: 15/687,647

(22) Filed: Aug. 28, 2017

(65) Prior Publication Data

US 2018/0135951 A1 May 17, 2018

Related U.S. Application Data

(60) Provisional application No. 62/422,083, filed on Nov. 15, 2016.

(51) Int. Cl.

| | |
|---|---|
| ***F42B 6/04*** | (2006.01) |
| ***F42B 12/38*** | (2006.01) |
| ***F42B 6/06*** | (2006.01) |
| ***F42B 12/36*** | (2006.01) |

(52) U.S. Cl.

CPC ..... *F42B 12/38* (2013.01); *F42B 6/04* (2013.01); *F42B 6/06* (2013.01); *F42B 12/362* (2013.01); *F42B 12/385* (2013.01)

(58) Field of Classification Search

CPC ..... F42B 6/04; F42B 6/06; F42B 6/08; F42B 12/385

See application file for complete search history.

(56) References Cited

U.S. PATENT DOCUMENTS

| | | | | | |
|---|---|---|---|---|---|
| 3,790,948 | A * | 2/1974 | Ratkovich | F42B 6/04 | 342/386 |
| 4,675,683 | A * | 6/1987 | Robinson | F42B 6/04 | 342/386 |
| 4,885,800 | A * | 12/1989 | Ragle | F42B 12/385 | 455/127.1 |
| RE33,470 | E * | 12/1990 | Boy | F42B 12/385 | 342/386 |
| 5,141,229 | A * | 8/1992 | Roundy | F42B 12/385 | 200/61.53 |

OTHER PUBLICATIONS

"Loc8tor" User Guide, from www.Loc8tor.com, copyright 2006.*

* cited by examiner

*Primary Examiner* — John Ricci
(74) *Attorney, Agent, or Firm* — The Keys Law Firm PLLC

(57) ABSTRACT

A sound emitting trackable arrow having an elongated cylindrical shaft that includes an insert member attached at one end and a nock member attached to the other end. A wireless tracking component may be coupled with either the insert member or the nock member, with the wireless tracking component fully enclosed inside the shaft. The wireless tracking component includes a plurality of electronic components which enable it to emit an audible sound in response to receiving an alert signal wirelessly and emit a signal strength value wirelessly which enables a real time proximity determination. A discrete, remote tracking device that is adapted to provide a user interface and to communicate wirelessly with the wireless tracking component is also provided. The remote tracking device is operative to continually maintain and display a determination of the approximate distance of the arrow and selectively cause the arrow emit an audible sound.

20 Claims, 2 Drawing Sheets

SOUND EMITTING TRACKABLE ARROW

CROSS REFERENCE TO RELATED APPLICATIONS

This application claims the benefit of and incorporates by reference U.S. provisional patent application Ser. No. 62/422,083 filed Nov. 15, 2016.

BACKGROUND OF THE INVENTION

Field of the Invention

This invention relates generally to tracking systems and, more particularly, to a trackable arrow that can emit an audible sound in response to a remotely generated signal.

Description of the Prior Art

The use and design of an arrow, namely a shafted projectile typically shot with a bow, is generally well known and in fact predates recorded history. Indeed, the general construction of a shaft with an arrowhead at a distal end and a nock, and possibly a fletching, at a proximal end has existed for millennia. While these underlying components and how they are arranged has remained relatively consistent throughout the years, modern times has seen the use of a wider variety of materials used to construct the underlying components. For example, while the shaft may have historically been defined by a generally cylindrical solid shaft made of wood, modern shafts are often defined by a hollow cylinder that is constructed of carbon fiber or other rigid material. In addition, instead of an arrowhead and nock being fixedly mounted to the shaft as seen in many traditional designs, some modern arrows employ an insert that can be fixed to the shaft at the time of use that allows for varying arrow points to be removably attached as well as a nock which can be fixed to the shaft at the time of use.

Despite such advances, a problem which still exists is that existing arrows often remain as difficult to locate once shot from a bow. Thus, there remains a need for a sound emitting trackable arrow which can be selectively caused to emit an audible sound to assist in locating and recovering the arrow. It would be helpful if such a sound emitting trackable arrow included a wireless tracking component adapted to communicate data wirelessly with a remote tracking device. It would be additionally desirable for the wireless tracking component on such a sound emitting trackable arrow to be disposed in the hollow shaft of the arrow to protect it from damage when the housing arrow is shot.

The Applicant's invention described herein provides for a sound emitting trackable arrow adapted to emit a sound that allows it to be located in response to receiving a wireless signal from a remote tracking device. The primary components of Applicant's sound emitting trackable arrow are an arrow base having an insert and a nock, a wireless tracking component, and a remote tracking device. When in operation, the sound emitting trackable arrow allows a user to recover arrows once they have been shot by following an audible sound that is selectively generated from within the arrow. As a result, many of the limitations imposed by the fixed prior art are removed.

SUMMARY OF THE INVENTION

The present disclosure describes a sound emitting trackable arrow having an elongated cylindrical shaft that includes an insert member attached at one end and a nock member attached to the other end. A wireless tracking component may be coupled with either the insert member or the nock member, with the wireless tracking component fully enclosed inside the shaft. The wireless tracking component includes a plurality of electronic components which enable it to emit an audible sound in response to receiving an alert signal wirelessly and emit a signal strength value wirelessly which enables a real time proximity determination. In one embodiment, such electronic components include an onboard power source, a controller, a wireless beacon, an antenna, and a speaker.

A discrete, remote tracking device that is adapted to provide a user interface and to communicate wirelessly with the wireless tracking component is also provided. The remote tracking device is operative to selectively transmit the alert signal to the wireless tracking component as well as receive the signal strength value from the wireless tracking component so as to calculate in real time the proximity of the wireless tracking component to the remote device based on a comparison between the signal strength value and a Received Signal Strength Indicator reading at the remote device. In this regard, once a user shoots an assembled sound emitting trackable arrow, the remote tracking device continually maintains a determination of the approximate distance of the arrow. As a user seeking to recover the arrow moves closer to the arrow, the user may cause from the remote tracking device the arrow emit an audible sound, making it significantly easier to both move towards the arrow and locate and recover the arrow.

The present apparatus may provide a sound emitting trackable arrow which can be selectively caused to emit an audible sound to assist in locating and recovering the arrow.

The present apparatus may also provide a sound emitting trackable arrow which includes a wireless tracking component adapted to communicate data wirelessly with a remote tracking device.

The present apparatus may further provide a sound emitting trackable arrow with a wireless tracking component that is disposed in the hollow shaft of the arrow to protect it from damage when the housing arrow is shot.

DETAILED DESCRIPTION OF THE INVENTION

Figure 1:
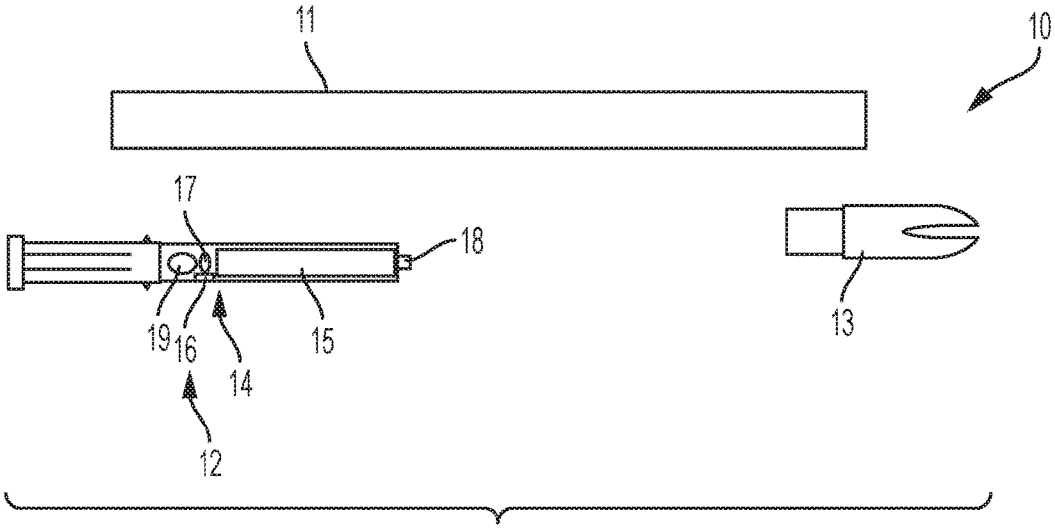
FIG. 1 is an exploded side elevational view of a sound emitting trackable arrow built in accordance with a front wireless tracking embodiment of the present invention.
Figure 2:
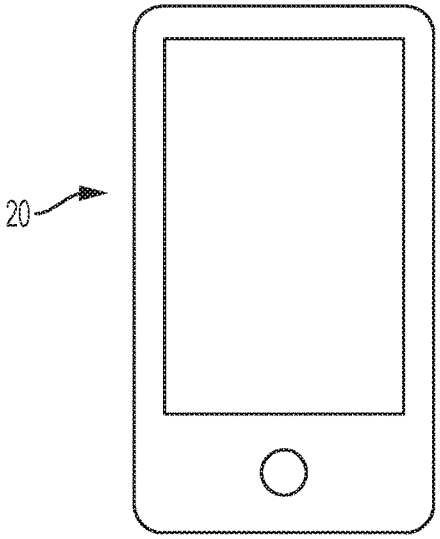
FIG. 2 is shows a front elevational view of a remote tracking device built in accordance with the present invention.

Referring now to the drawings and in particular FIGS. 1 and 2, an embodiment of a sound emitting trackable arrow 10 is shown having a shaft 11 defined by an elongated cylindrical member having a proximal end and a distal end. In one embodiment, the shaft 11 is sized and shaped to receive an insert member 12 as a distal member into the distal end and a nock member 13 as a proximal member into the proximal end such that each of the insert member 12 and the nock member 13 may be frictionally secured in place and/or otherwise fixed in place. In this regard, the shaft 11, insert member 12 and nock member 13 may form the principle elements of an assembled arrow (not shown) suitable for shooting from a bow (not shown). As with many modern assembled arrows, an arrowhead may be mountable to the insert member 12.

In the front wireless tracking embodiment, the insert member 12 additionally includes a wireless tracking component 14 coupled therewith, positioned relative to the insert member 12 such that the wireless tracking component 14 will be fully enclosed inside the shaft 11 when the insert member 12 is inserted into the shaft 11. The wireless tracking component 14 includes an onboard power source 15, a controller 16, a wireless beacon 17, an antenna 18, and a speaker 19, each of which are electrically interconnected to allow the power source 15 to supply electricity to the other components and the controller 16 to control the operation of the other components. In one embodiment, a Bluetooth low energy beacon defines the wireless beacon 17. In this regard, the wireless tracking component 14 is configured to broadcast an identifier and a Measured Power value to a nearby portable electronic device through the wireless beacon 17, receive wireless electrical signals through the antenna 18, and send an electrical signal from the controller 16 to the speaker 19 which causes the speaker 19 to emit an audible sound. It is contemplated that the Measured Power value provides a signal strength value which in one embodiment, represents the expected Received Signal Strength Indicator at a distance of one (1) meter to the beacon.

In one embodiment, the remote tracking device 20 is defined by a conventional mobile computer device, such as a smart phone or tablet, that includes a Bluetooth interface that allows it to receive wireless transmissions from the wireless beacon 17 and read a Received Signal Strength Indicator ("RSSI") for incoming transmissions, a wireless transmitter that allows it to send electrical signals wirelessly to the antenna 18, and a user interface that allows it to receive an input from a user that commands the sending of the electrical signal to the antenna 18 and generate an output related to the approximate distance of the wireless beacon 17 from the remote tracking device 20. In one embodiment, the remote tracking device 20 includes a software application that provides the instructions to its electronic components for the performance of such operations, as well as for the calculation of approximate distance between the wireless beacon and the remote tracking device based on a Measured Power value received and an RSSI reading.

In the operation of embodiments in which the wireless beacon 17 and the antenna are always powered, as long as the power source 15 is energized, the wireless beacon 17 periodically emits a wireless signal that contains its identifier and Received Measured Power value so as to allow a remote tracking device 20 to receive and monitor signals from the wireless beacon 17 and enable the identification of the wireless beacon 17 and a real time approximation of the distance between the wireless beacon 17 and the remote tracking device 20. As such, once a user shoots an assembled sound emitting trackable arrow 10 built in accordance with the present invention (i.e., an arrow having a wireless tracking component 14 with a monitored wireless beacon 17), the remote tracking device 20 continually maintains a determination of the approximate distance of the arrow 10 based on a comparison of the Measured Power value of the wireless beacon 17 and the RSSI reading observed by the remote tracking device 20. This real time approximate distance determination allows a user holding the remote tracking device 20 to know whether they are walking towards the arrow 10 or away from the arrow 10 (and thus ensure they are moving closer to the arrow).

As a user seeking to recover the arrow 10 moves closer to the arrow 10, as evidenced by the approximate distance output of the remote tracking device 20, the user may actuate the interface of the remote tracking device 20 to cause it to send a wireless electrical signal to the antenna 18 inside the arrow 10. In one embodiment, this wireless electrical signal includes a command that causes the controller 16 to send a signal to the speaker 19 that causes the speaker 10 emit an audible sound. As such, if this signal from the remote tracking device 20 is received, the arrow 10 will begin to emit an audible sound that, in addition to following the distance readout on the remote tracking device 20, makes it even easier to move towards the arrow 10 and locate and recover the arrow 10.

In one embodiment, the antenna 18 defines an RF antenna and the remote tracking device 20 transmits an RF signal as the wireless electrical signal to the antenna 18 inside the arrow 10.

In one embodiment, the power source 15 is defined by a battery. In other embodiments, the power source 15 includes a rechargeable battery and an induction coil operative to take power from an electromagnetic field generated from electricity by an external induction coil in close proximity and covert the field back into electric current to recharge the rechargeable battery.

Figure 3:
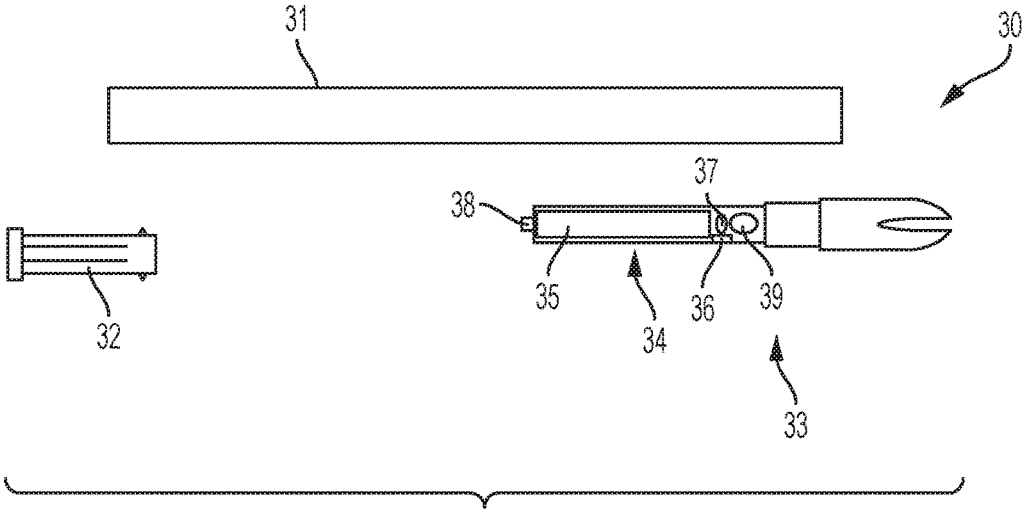
FIG. 3 is an exploded side elevational view of a sound emitting trackable arrow built in accordance with a rear wireless tracking embodiment of the present invention.

Referring now to FIG. 3, in the rear wireless tracking embodiment, a sound emitting trackable arrow 30 also includes a shaft 31, insert member 32 and nock member 33 that form the principle elements of an assembled arrow (not shown) suitable for shooting from a bow (not shown). In the rear wireless tracking embodiment however, the nock member 33 includes a wireless tracking component 34 coupled therewith, positioned relative to the nock member 33 such that the wireless tracking component 34 is enclosed inside the shaft 31 when the nock member 33 is inserted into the shaft 31. As with the front wireless tracking embodiment, the wireless tracking component 34 in the rear wireless tracking embodiment includes an onboard power source 35, a controller 36, a wireless beacon 37, an antenna 38, and a speaker 39. Each of the electrical components of the wireless tracking component 34 are interconnected in the same manner as in the front wireless tracking embodiment, and when operating with a remote tracking device configured in accordance with the present invention, operate in the same manner as in the front wireless tracking embodiment.

In one embodiment, the wireless tracking component may additionally include an accelerometer which is electrically interconnected with the power source and the controller and operates to transmit an electrical signal to the controller in response to a sudden increase or decrease in acceleration of the wireless tracking component (and thus the arrow in which the wireless tracking component is housed). In such an embodiment, the controller responds to the receipt of the acceleration driven electrical signal by supplying power to the wireless beacon and/or the antenna of the wireless tracking component, which in such an embodiment would not be supplied power when manufactured and/or sold. Accordingly, stored electrical power in the power source would be conserved because the wireless beacon and the antenna would only begin to draw substantial electrical power from the power source when the arrow housing such a wireless tracking component was shot from a bow (as a sudden increase in acceleration) or came to rest after being shot (as a sudden decrease in acceleration).

It is appreciated that the threshold value of acceleration required to cause the controller to activate the wireless beacon and the antenna would be stored in firmware or other software stored on or accessible to the controller.

In one embodiment, the wireless tracking component may additionally include a shock detector which operates to generate an electrical signal in response to a physical shock or impact being sustained. In such an embodiment, the controller responds to the receipt of the shock driven electrical signal by supplying power to the wireless beacon and/or the antenna of the wireless tracking component, which in such an embodiment would not be supplied power when manufactured and/or sold. Accordingly, stored electrical power in the power source would be conserved because the wireless beacon and the antenna would only begin to draw substantial electrical power from the power source when the arrow housing such a wireless tracking component impacted an object after being shot.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A sound emitting trackable arrow, comprising:

a shaft defined by an elongated cylindrical member having a proximal end and a distal end;

a proximal member configured to be secured to the proximal end of the shaft;

a distal member configured to be secured to the distal end of the shaft; and a wireless tracking component integral with at least one of the distal member and the proximal member, wherein said wireless tracking component is configured to emit an audible sound in response to receiving an alert signal wirelessly; and wherein said wireless tracking component includes a wireless beacon and is additionally configured to emit a signal strength value wirelessly from the wireless beacon which enables a real time proximity determination.

2. The sound emitting trackable arrow of claim 1, wherein said wireless tracking component is integral with the distal member.

3. The sound emitting trackable arrow of claim 2, wherein said wireless tracking component is configured so as to be fully enclosed in the shaft when the distal member is secured to the distal end.

4. The sound emitting trackable arrow of claim 3, wherein said proximal member includes a nock.

5. The sound emitting trackable arrow of claim 3, additionally comprising a remote device adapted to receive the signal strength value from the wireless tracking component and transmit the alert signal to the wireless tracking component, wherein said remote device is configured to calculate in real time the proximity of the wireless tracking component to the remote device based on a comparison between the signal strength value and a Received Signal Strength Indicator reading at the remote device.

6. The sound emitting trackable arrow of claim 3, wherein said wireless tracking component includes at least an antenna, a controller, and a power source, wherein said controller is adapted to selectively supply electricity from the power source to the wireless beacon and the antenna.

7. The sound emitting trackable arrow of claim 6, wherein said wireless tracking component is configured to initiate the supply of electricity to the wireless beacon and the antenna upon at least one of the shaft, proximal member and distal member coming to rest after being shot from a bow and impacting an object after being shot from a bow.

8. The sound emitting trackable arrow of claim 1, wherein said wireless tracking component is integral with the proximal member.

9. The sound emitting trackable arrow of claim 8, wherein said wireless tracking component is configured so as to be fully enclosed in the shaft when the proximal member is secured to the proximal end.

10. The sound emitting trackable arrow of claim 9, wherein said proximal member includes a nock.

11. The sound emitting trackable arrow of claim 9, additionally comprising a remote device adapted to receive the signal strength value from the wireless tracking component and transmit the alert signal to the wireless tracking component, wherein said remote device is configured to calculate in real time the proximity of the wireless tracking component to the remote device based on a comparison between the signal strength value and a Received Signal Strength Indicator reading at the remote device.

12. The sound emitting trackable arrow of claim 9, wherein said wireless tracking component includes at least an antenna, a controller, and a power source, wherein said controller is adapted to selectively supply electricity from the power source to the wireless beacon and the antenna.

13. The sound emitting trackable arrow of claim 12, wherein said wireless tracking component is configured to initiate the supply of electricity to the wireless beacon and the antenna upon at least one of the shaft, proximal member and distal member coming to rest after being shot from a bow and impacting an object after being shot from a bow.

14. A sound emitting trackable arrow, comprising:

a shaft defined by an elongated cylindrical member having a proximal end and a distal end;

a proximal member configured to be secured to the proximal end of the shaft;

a distal member configured to be secured to the distal end of the shaft;

a wireless tracking component integral with at least one of the distal member and the proximal member, wherein said wireless tracking component includes a wireless beacon and is configured to emit a signal strength value wirelessly from the wireless beacon which enables a real time proximity determination; and a remote device adapted to receive the signal strength value from the wireless tracking component and calculate in real time the proximity of the wireless tracking component to the remote device based on a comparison between the signal strength value and a Received Signal Strength Indicator reading at the remote device.

15. The sound emitting trackable arrow of claim 14, wherein said wireless tracking component is configured to emit an audible sound in response to receiving an alert signal wirelessly and said remote device is additionally configured to transmit the alert signal to the wireless tracking component.

16. The sound emitting trackable arrow of claim 15, wherein said wireless tracking component includes at least an antenna, a controller, and a power source, wherein said controller is adapted to selectively supply electricity from the power source to the wireless beacon and the antenna.

17. The sound emitting trackable arrow of claim 16, wherein said wireless tracking component is configured to initiate the supply of electricity to the wireless beacon and the antenna upon at least one of the shaft, proximal member and distal member coming to rest after being shot from a bow and impacting an object after being shot from a bow.

18. A sound emitting trackable arrow, comprising:

a shaft defined by an elongated cylindrical member having a proximal end and a distal end;

a proximal member configured to be secured to the proximal end of the shaft;

a distal member configured to be secured to the distal end of the shaft;

a wireless tracking component integral with at least one of the distal member and the proximal member, wherein said wireless tracking component is configured to emit an audible sound in response to receiving an alert signal wirelessly;

wherein said wireless tracking component includes a wireless beacon and is additionally configured to emit a signal strength value wirelessly from the wireless beacon which enables a real time proximity determination; and a remote device adapted to receive the signal strength value from the wireless tracking component and transmit the alert signal to the wireless tracking component, wherein said remote device is configured to calculate in real time the proximity of the wireless tracking component to the remote device based on a comparison between the signal strength value and a Received Signal Strength Indicator reading at the remote device.

19. The sound emitting trackable arrow of claim 18, wherein said wireless tracking component includes at least an antenna, a controller, and a power source, wherein said controller is adapted to selectively supply electricity from the power source to the wireless beacon and the antenna.

20. The sound emitting trackable arrow of claim 19, wherein said wireless tracking component is configured to initiate the supply of electricity to the wireless beacon and the antenna upon at least one of the shaft, proximal member and distal member being coming to rest after being shot from a bow and impacting an object after being shot from a bow.

* * * * *